US007176424B2

(12) United States Patent
Kim

(10) Patent No.: US 7,176,424 B2
(45) Date of Patent: Feb. 13, 2007

(54) INDUCTION HEATING COOKING APPARATUS AND METHOD FOR OPERATING THE SAME

(75) Inventor: Eui Sung Kim, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/257,072

(22) Filed: Oct. 25, 2005

(65) Prior Publication Data

US 2006/0086728 A1 Apr. 27, 2006

(30) Foreign Application Priority Data

Oct. 26, 2004 (KR) ..... 10-2004-0085843

(51) Int. Cl.
*H05B 6/08* (2006.01)
*H05B 6/12* (2006.01)

(52) U.S. Cl. ..... 219/626; 219/664; 219/665; 363/78

(58) Field of Classification Search ..... 219/625–627, 219/663–668; 363/78–79, 97
See application file for complete search history.

(56) References Cited

FOREIGN PATENT DOCUMENTS

| | | | |
|---|---|---|---|
| GB | 2 062 985 A | 5/1981 | |
| GB | 2 162 384 A | 1/1986 | |
| GB | 2 181 030 A | 4/1987 | |
| JP | 4-282595 | * 10/1992 | ..... 219/664 |

* cited by examiner

*Primary Examiner*—Philip H. Leung
(74) *Attorney, Agent, or Firm*—Birch, Stewart, Kolasch & Birch, LLP

(57) ABSTRACT

An induction-heating cooking apparatus and a method for operating the same are disclosed. Upon receiving a low-voltage signal in a high-output level state, the apparatus controls an output signal to allow an inverter to be operated only in a ZVS (Zero Voltage Switching) area. If an input voltage applied to a circuit is a low voltage, the apparatus compensates for the input voltage using a smaller one between a blocking voltage and an output control signal generated from the microprocessor, thereby limiting a compensation component. Therefore, the apparatus prevents the occurrence of a power loss caused by an excessive switching operation, and also prevents a switch from receiving a high instantaneous current, resulting in increased endurance of cooking appliances.

15 Claims, 7 Drawing Sheets

INDUCTION HEATING COOKING APPARATUS AND METHOD FOR OPERATING THE SAME

BACKGROUND OF THE INVENTION

1. Field of the Invention

The present invention relates to an inverter circuit for use in an induction-heating cooking apparatus and a method for operating the same, which block an inverter circuit from being operated under a resonance frequency according to a substance of a heating container upon receiving a low-voltage signal in a high-output state of the induction-heating cooking apparatus, prevent a switch having a relatively low current from being damaged, resulting in increased endurance.

2. Description of the Related Art

Generally, a cooking appliance (also called a cooking apparatus) includes: a main body having a control board capable of determining whether a power-supply signal is received upon receiving a command signal from a user; a cooking container seated in the main body, for including food therein; and a cooking heater installed to a lower part of the cooking container or an inner side of the main body to cook the food included in the cooking container.

An induction-heating scheme arranges coils in the main body wherein the cooking container is seated at intervals of a predetermined distance, and allows an eddy current to be generated in the cooking container formed of a magnetic material due to a magnetic field generated when a current signal flows in the coil, thereby heating the cooking container. A variety of kitchen appliances, for example, a rice cooker, a cook-top range, and an electric pan, etc., have been designed to use the above induction-heating scheme.

An inverter circuit for use in the above-mentioned induction-heating cooking apparatuses switches on or off a switch formed of an IGBT (Insulated Gate Bipolar Transistor), applies a high-frequency current having high power to the coil, and heats the container located on the coil.

The inverter circuit for use in the conventional induction-heating cooking apparatus will hereinafter be described with reference to FIG. 1. Referring to FIG. 1, the inverter circuit includes an AC power-supply unit 1 for generating a common AC power-supply signal; a rectifier 2 for rectifying the AC power-supply signal; a filter unit 3 for filtering a power-supply signal rectified by the rectifier 12; and an inverter unit 4 for receiving the filtered power-supply signal from the filter unit 3, switching on the switch, and providing the coil with a high-output power-supply signal.

An input voltage detector 5 is connected to the AC power-supply unit 1, and detects a voltage applied to the inverter circuit. An input voltage compensator 6 compensates for an output control signal generated by a microprocessor of a cooking apparatus according to a variation of the detected input voltage.

In other words, if the input voltage detector 5 detects an input voltage higher than a reference rated input voltage, the input voltage compensator 6 reduces a voltage value of an inverter output control signal generated from a microprocessor. Otherwise, if the input voltage detector 5 detects an input voltage less than the reference rated input voltage, the input voltage compensator 6 increases a voltage value of the inverter output control signal in such a way that it compensates for an inverter output control signal according to a variation of the input voltage.

The output controller 7 generates a frequency control signal capable of controlling an operation frequency of the inverter unit 4 according to an output voltage level generated from the input voltage compensator 6, and generates a constant output signal irrespective of the variation of the input voltage.

In more detail, the output controller 7 generates a frequency control signal, such that it increases the operation frequency when the input voltage is higher than a reference output control signal, and reduces the operation frequency upon receiving a voltage signal less than the reference output control signal.

Upon receiving the frequency control signal, a pulse generator 8 generates a driving pulse to allow the switch of the inverter unit 4 to be switched on or off at the operation frequency. A switch driver 9 transmits the driving pulse to a gate of the switch, and switches on the switch, so that it generates a constant-output signal.

In this case, the operation frequency of the inverter unit 4 is controlled by the output controller 7. The degree of magnetism is changed according to a substance of a cooking container seated on the coil, and a resonance frequency is also changed due to the changed magnetism.

Therefore, the output controller 7 establishes an operation frequency to prevent the inverter unit 4 from being operated under the resonance frequency caused by the substance of the cooking container, such that it increases power output efficiency, and drives the inverter according to a ZVS (Zero Voltage Switching) scheme.

However, when the cooking container is installed in the conventional induction-heating cooking apparatus, or a low-input voltage is applied to the induction-heating cooking apparatus, a resonance frequency is different from that determined by the microprocessor, such that it is difficult to guarantee the ZVS operation of the inverter, as shown in FIG. 2.

Referring to FIG. 2, if a resonance frequency f2 of the cooking container formed of a substance B is set to an operation limitation frequency of the inverter, the inverter can escape from the ZVS operation area when another cooking container formed of a substance A having a resonance frequency f1 is seated, such that the cooking container is unable to generate the maximum output level.

Upon receiving an input voltage less than a rated input voltage when the cooking container formed of the substance B is operated at the resonance frequency f2 capable of generating the maximum power signal P2, the input voltage compensator 6 increases an inverter output control signal, and the output controller 7 generates a frequency output control signal to reduce the switching operation frequency, such that the operation of the inverter escapes from a predetermined area ZVS2.

Therefore, if the inverter operation escapes from the ZVS2 operation area, the switch encounters an excessive switching operation and a high instantaneous current when it is switched on, such that the IGBT switch may be damaged. As a result, there arises a malfunction of the induction-heating cooking apparatus, resulting in unnecessary repair costs and deterioration of endurance.

SUMMARY OF THE INVENTION

Therefore, the present invention has been made in view of the above problems, and it is an object of the invention to provide an induction-heating cooking apparatus and a method for operating the same, which include a low-voltage detector and an output level limiter such that an inverter circuit can be operated in a ZVS operation area even if a low-voltage signal is received in the apparatus under a high-output state.

It is another object of the present invention to provide an induction-heating cooking apparatus and a method for operating the same, which establish an inverter operation frequency improper for an actual substance of a cooking container, detect a low-voltage input state under a high-output state using the inverter operation frequency, and limit an output level, such that an inverter unit does not escape from a ZVS operation area, resulting in reduction of the possibility of damaging a necessary element and increased endurance of the cooking apparatus.

In accordance with one aspect of the present invention, these objects are accomplished by providing an induction-heating cooking apparatus comprising: an inverter unit for performing a switching operation upon receiving a driving pulse, and providing a coil, on which a cooking container is seated, with a current signal; a low-voltage detector for changing a low-voltage decision signal to a low-level signal when an input voltage applied to a circuit is less than a reference low-voltage; and a power-level limiter for generating a blocking voltage capable of limiting an output power level to a predetermined power level only when the low-voltage decision signal is a low-level signal.

The induction-heating cooking apparatus further comprises: a microprocessor for generating an output control signal to allow the inverter unit to generate an output signal suitable for individual output levels; an input voltage compensator for determining a smaller one between the output control signal and the blocking voltage, and compensating the determined smaller one according to a variation of the input voltage; an output controller for generating a frequency control signal capable of controlling a switching operation frequency of the inverter unit to compensate for an output power level according to a compensation component of the input voltage compensator; a pulse generator for generating a driving pulse, a frequency of which is changed according to the frequency control signal; and a switch driver for transmitting the driving pulse generated from the pulse generator to a gate of a switch contained in the inverter unit.

In accordance with another aspect of the present invention, there is provided a method for operating an induction-heating cooking apparatus comprising the steps of: a) detecting an input voltage applied to a circuit; b) if the input voltage is less than a reference low-voltage, determining that a low-voltage signal is received; c) upon receiving the low-voltage signal, determining whether an output control signal generated from a microprocessor is higher than a blocking voltage; d) compensating for the blocking voltage according to a variation of the input voltage when the output control signal is higher than the blocking voltage, and compensating for the output control signal according to a variation of the input voltage when the output control signal is equal to or less than the blocking voltage in such a way that an output control operation is performed; and e) controlling an operation frequency according to an input voltage compensation component, and driving an inverter.

In other words, the apparatus limits the output control signal to the predetermined blocking voltage when receiving a low-voltage signal in a high-output level state, compensates for the input voltage, and prevents the inverter from escaping from a ZVS area, resulting in reduction of the possibility of damaging a necessary element and increased endurance of cooking appliances.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Figure 1:
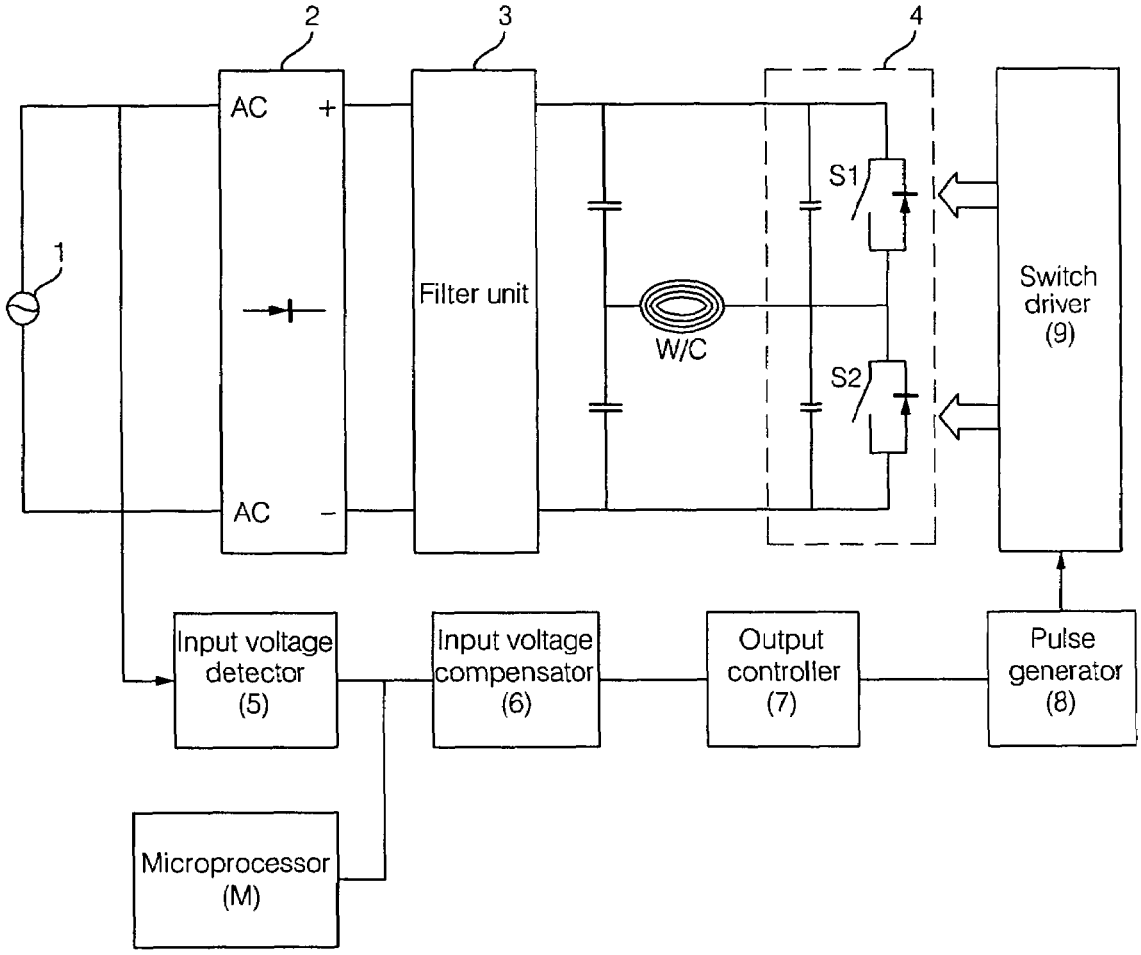
FIG. 1 (Prior Art)
FIG. 1 is a circuit diagram illustrating a conventional induction-heating cooking apparatus.
Figure 2:
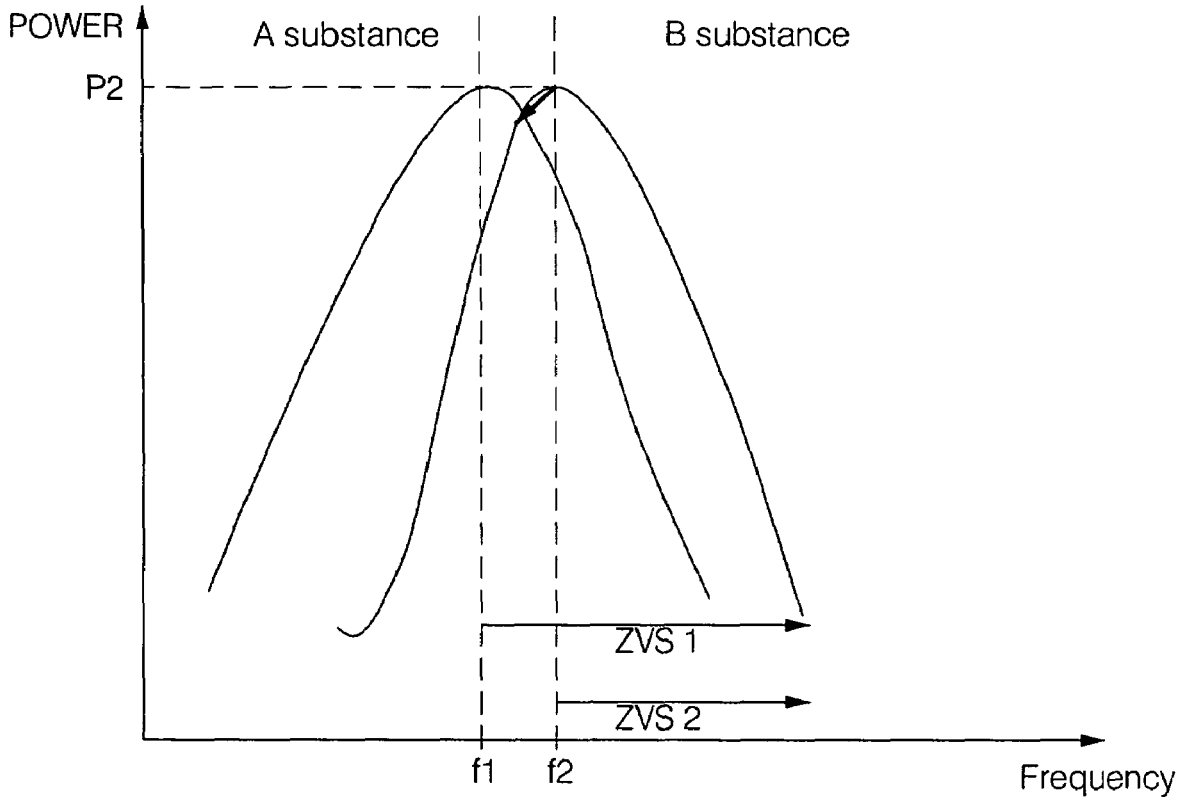
FIG. 2 is a graph illustrating power output characteristics depending on a substance of a cooking container.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present invention rather unclear.

An induction-heating cooking apparatus and a method for operating the same according to the present invention will hereinafter be described with reference to the annexed drawings. Prior to describing the present invention, it should be noted that the present invention is applicable to all kinds of cooking devices employing an induction-heating scheme.

Figure 3:
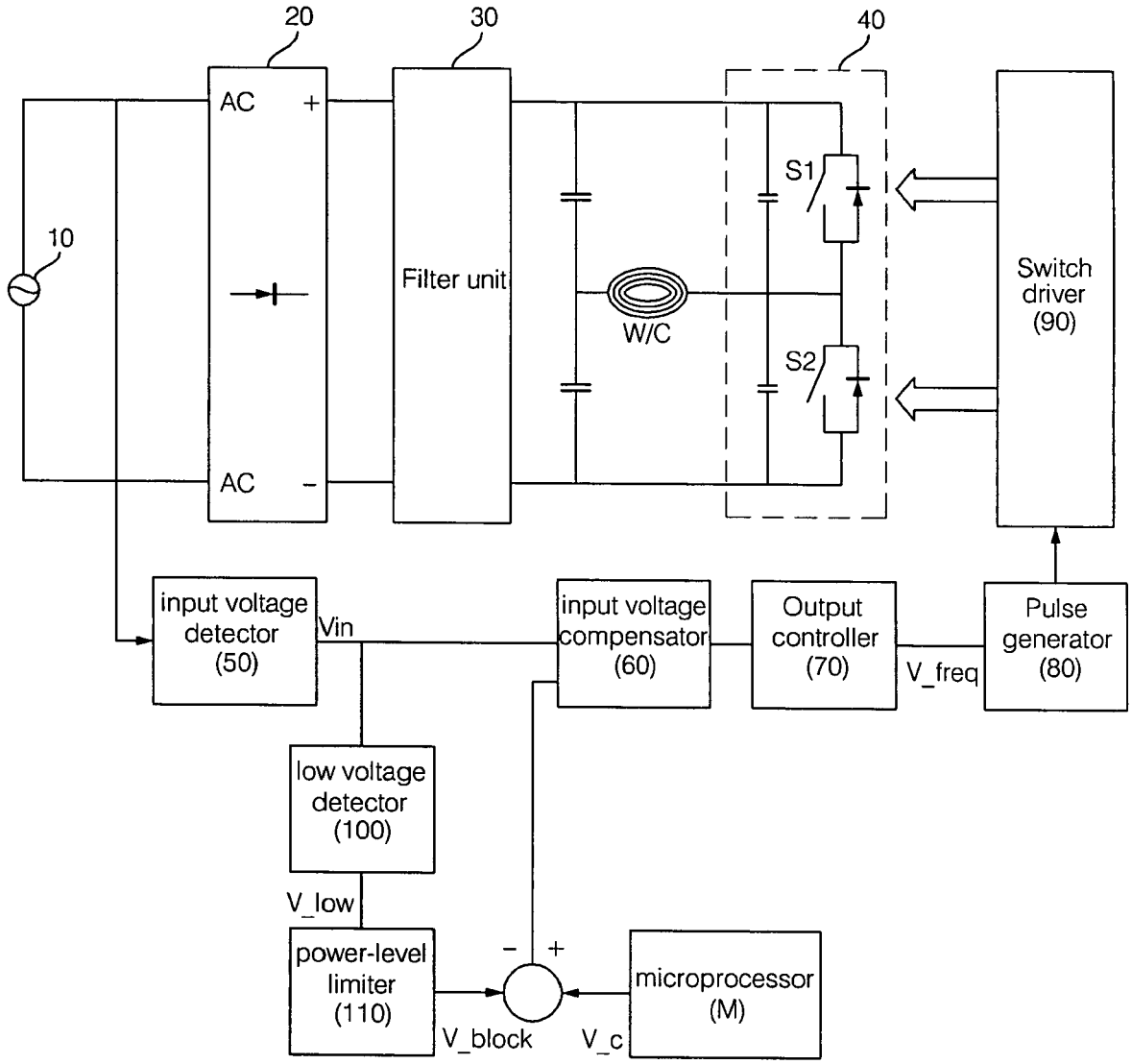
FIG. 3 is a circuit diagram illustrating an induction-heating cooking apparatus according to the present invention.

FIG. 3 is a circuit diagram illustrating an induction-heating cooking apparatus according to the present invention.

Referring to FIG. 3, an inverter circuit includes a switch, switches on the switch using a microprocessor for generating a control signal according to an output level adjusted by a user, and transmits a high frequency and a high current to a coil, such that it heats a container seated on the coil. The inverter circuit capable of generating the maximum output level has different resonance frequencies according to a substance of the cooking container.

The above-mentioned inverter circuit includes an AC power-supply unit 10 for generating a common AC power-supply signal; a rectifier 20 for rectifying the AC power-supply signal; and a filter unit 30 for filtering the AC power-supply signal rectified by the rectifier 20.

The power-supply signal generated from the AC power-supply unit 10 may vary from country to country or state to state, but the present invention exemplarily uses an AC power-supply signal of 230V at 50 Hz. The rectifier 20 rectifies the AC power-supply signal into a predetermined signal of 230V at 100 Hz using a rectifying diode, and generates a ripple power-supply signal. The filter unit 30 filters the ripple power-supply signal rectified by the rectifier 20, and outputs the filtered power-supply signal to the inverter unit 40.

The inverter unit 40 switches on the switch upon receiving the rectified power-supply signal from the filter unit 30, transmits a current signal to the coil, and heat the cooking container.

In order to stably operate the inverter unit 40, an input voltage detector 50, an input voltage compensator 60, an output controller 70, a pulse generator 80, and a switch driver 90 are connected to each other.

The induction-heating cooking apparatus according to the present invention includes a low-voltage detector 100 for determining whether the input voltage (Vin) detected by the input voltage detector 50 is a low voltage; and a power-level limiter 110 for providing the input voltage compensator 60 with a blocking voltage signal (V_block) capable of limiting an output power level upon receiving the low-voltage signal.

In this case, the input voltage compensator 60 determines which one of an output control signal (Vc) generated from a microprocessor M and the blocking voltage signal (V_block) generated from the power-level limiter 110 is a low voltage signal, and compensates for the determined low voltage signal according to a variation of the input voltage (Vin), whereas the conventional input voltage compensator 6 has been designed to compensate for only an output control signal (V_c) according to the variation of the input voltage (Vin).

Figure 4:
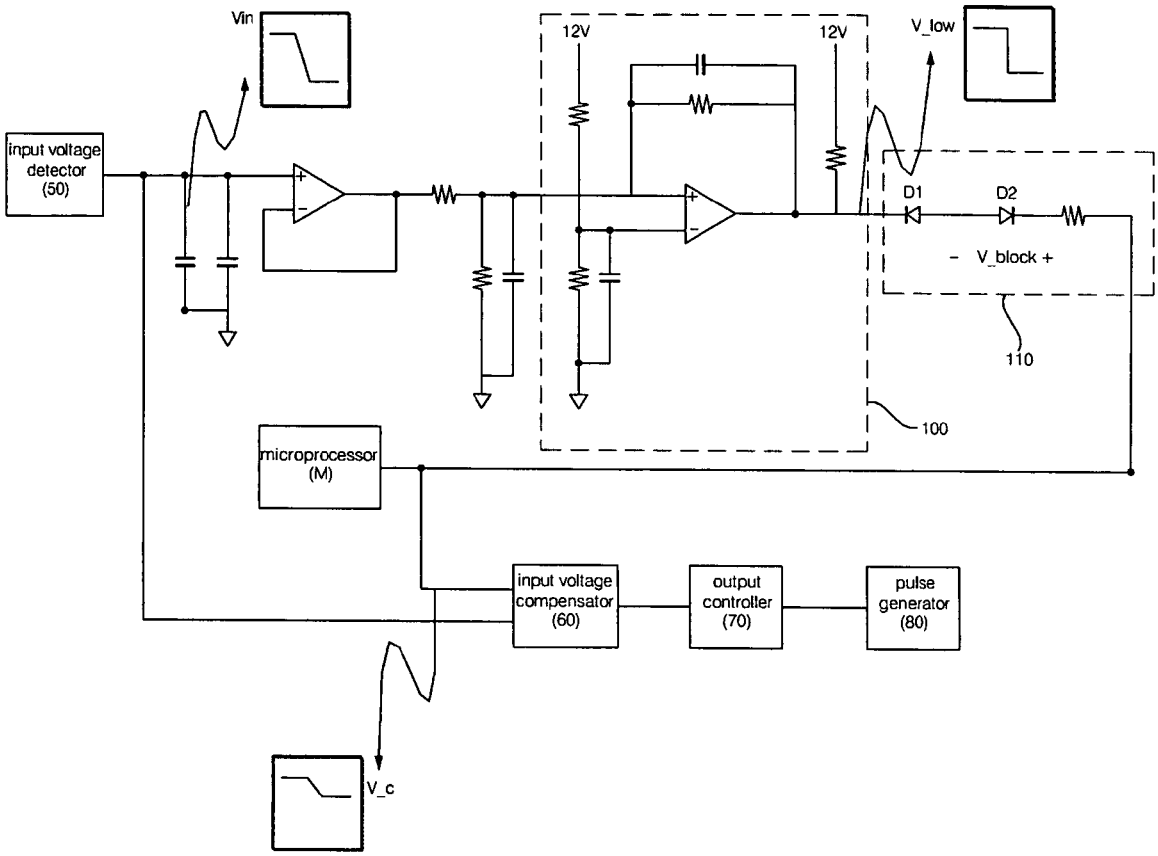
FIG. 4 is a detailed circuit diagram illustrating a low-voltage detector and a power-level limiter according to the present invention.

Individual components for use in the induction-heating cooking apparatus will hereinafter be described with reference to FIGS. 3 and 4. FIG. 4 is a detailed circuit diagram illustrating the low-voltage detector 100 and the power-level limiter 110 according to the present invention.

The input-voltage detector 50 is directly connected to positive(+) and negative(−) terminals of the AC power-supply unit 10, and detects an input voltage (V_in) applied to the circuit.

The low-voltage detector 100 includes a comparator in which a positive(+) terminal receives the input voltage (Vin) detected by the input voltage detector 50, and a negative(−) terminal receives a reference low-voltage determined by a circuit designer. The reference low-voltage is provided when the voltage of Vcc is divided by a resistance ratio.

The low-voltage detector 100 generates a high-level signal when the input voltage (Vin) is equal to or higher than the reference low-voltage, and generates a low-level signal when the input voltage (Vin) is less than the reference low-voltage. The output signal of the low-voltage detector 100 is called a low-voltage decision signal (V_low). If the low-voltage decision signal (V_low) is a low-level signal, it is determined that a low-voltage signal is received in the induction-heating cooking apparatus according to the present invention.

The power-level limiter 110 receiving the low-voltage decision signal (V_low) includes a diode D1 connected in a reverse direction and a zener diode D2 connected in a forward direction.

If the low-voltage decision signal is a high-level signal, the diode D1 is not switched on, such that the output signal of the power-level limiter 110 is not applied to the input-voltage compensator 60. As a result, the output control signal (V_c) of the microprocessor M is transmitted to the input voltage compensator 60.

However, if the low-voltage decision signal is a low-level signal, i.e., if it is determined that the low-voltage signal is received in the low-voltage detector 100, the diode D1 is switched on, such that a voltage (V_d2=V_block) applied to both ends of the zener diode D2 is transmitted to the input voltage compensator 60.

The voltage applied to both ends of the zener diode D2 is a blocking voltage for limiting the output control signal (V_c) of the microprocessor M. If a substance of the cooking container is changed, or the input voltage (Vin) is lowered when the inverter unit generates the maximum output level, the blocking voltage prevents the inverter unit from being operated under a predetermined area (i.e., Zero Voltage Switching (ZVS) area) having a frequency less than a resonance frequency.

Therefore, the input voltage compensator 60 includes a first terminal for receiving the input voltage (Vin), and a second terminal for receiving the output control signal (V_c) generated from the microprocessor or the blocking voltage (V_block), and outputs a differential component between the input voltage (Vin) and one of the output control signal (V_c) and the blocking voltage (V_block), such that it compensates for an input voltage (Vin).

In this case, if the input voltage (Vin) is less than the reference low-voltage, a smaller one between the blocking voltage (V_block) and the output control signal (V_c) of the microprocessor is applied to the second terminal of the input voltage compensator 60.

Upon receiving the low-voltage signal, the input voltage compensator 60 limits the received low-voltage signal to the smaller one between the output control signal (V_c) and the blocking voltage (V_block) in such a way that it compensates for the input voltage. Therefore, the input voltage compensator 60 prevents an operation area of the inverter unit from being separated from the ZVS area although an excessive constant-output control operation is performed when receiving the low-voltage signal.

The output controller 70 generates a frequency control signal for controlling a switching operation frequency of the inverter unit 40 such that it can compensate for the output power by the output voltage level of the input voltage compensator 60.

For example, upon receiving a low-voltage signal, the input voltage compensator 60 reduces an operation frequency by the output voltage level of the input voltage compensator 60, thereby increasing the output power. Upon receiving a high-voltage signal, the input voltage compensator 60 increases the operation frequency, reduces the output power, and controls the inverter unit 40 to output a constant-output signal.

The pulse generator 80 switches on a transistor according to the frequency control signal (V_freq) generated from the constant-output generator 70, adjusts a resistance value of an oscillator (OSC), changes a frequency according to the OSC resistance value, and outputs a driving pulse.

The driving pulse, a frequency of which is controlled by the pulse generator 80, is applied to a gate of the switch contained in the inverter unit 40 via the switch driver 90, and a current signal is applied to the coil because the switching operation is performed.

Figure 5:
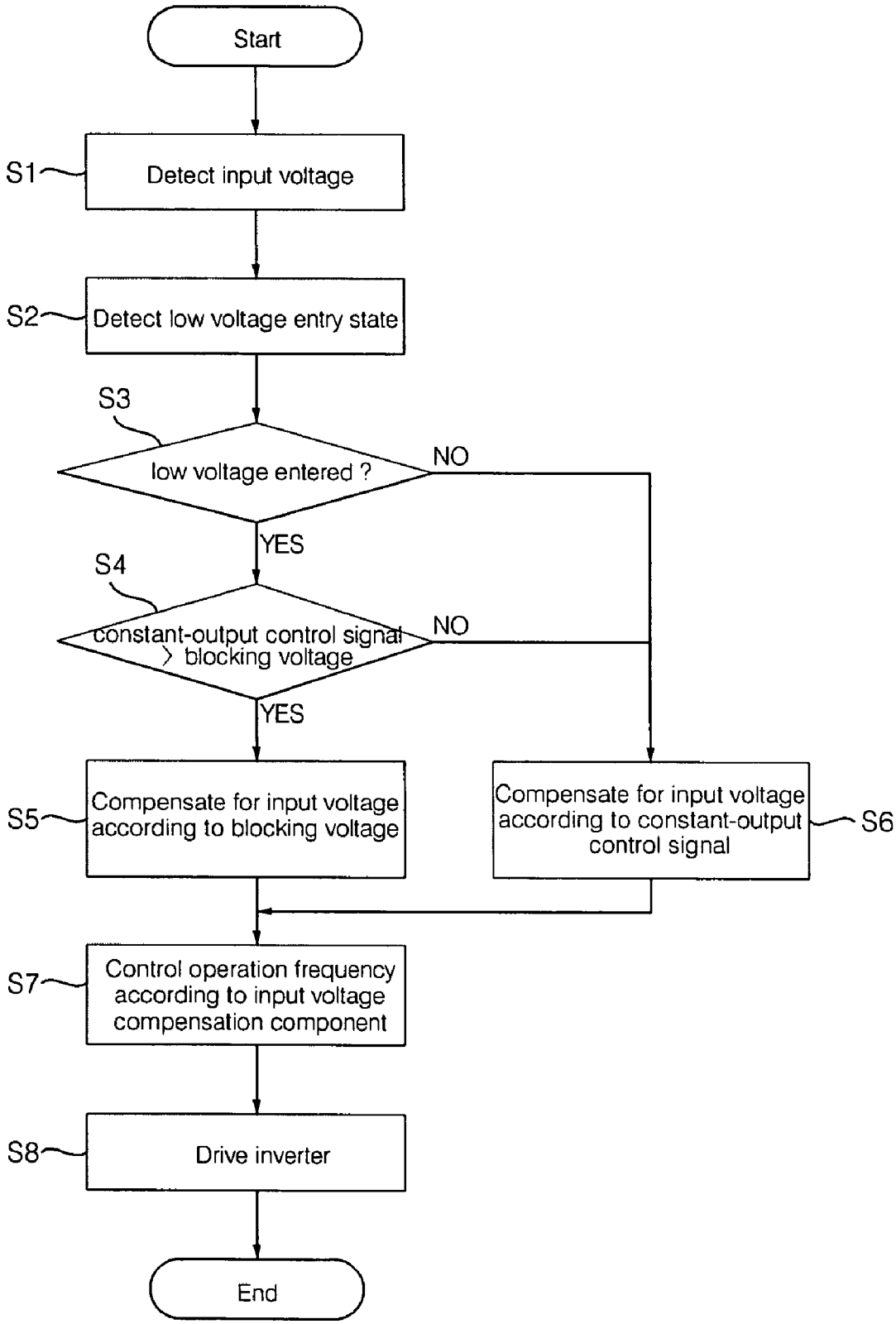
FIG. 5 is a flow chart illustrating a method for operating an induction-heating cooking apparatus according to the present invention.

If the above-mentioned induction-heating cooking apparatus detects the low voltage signal, a method for limiting a power level to a predetermined power level, preventing a high instantaneous current from being applied to the switch, and preventing the switch from being excessively switched will hereinafter be described with reference to FIGS. 5, 6*a*, and 6*b*.

The input voltage (Vin) applied to the circuit is detected at step S1.

The input voltage (Vin) is compared with the reference low voltage, and a low-voltage detection signal (V_low) is generated at step S2.

If the low-voltage detection signal is a high-level signal at step S3, an output control operation is performed using only the output control signal (V_c) generated from the microprocessor at step S6. If the low-voltage detection signal is a low-level signal so that it is determined that the low-voltage signal has been received at step S3, it is determined whether the output control signal (V_c) generated from the microprocessor is higher than the blocking voltage (V_block) generated from the power-level limiter at step S4.

Figure 6A:
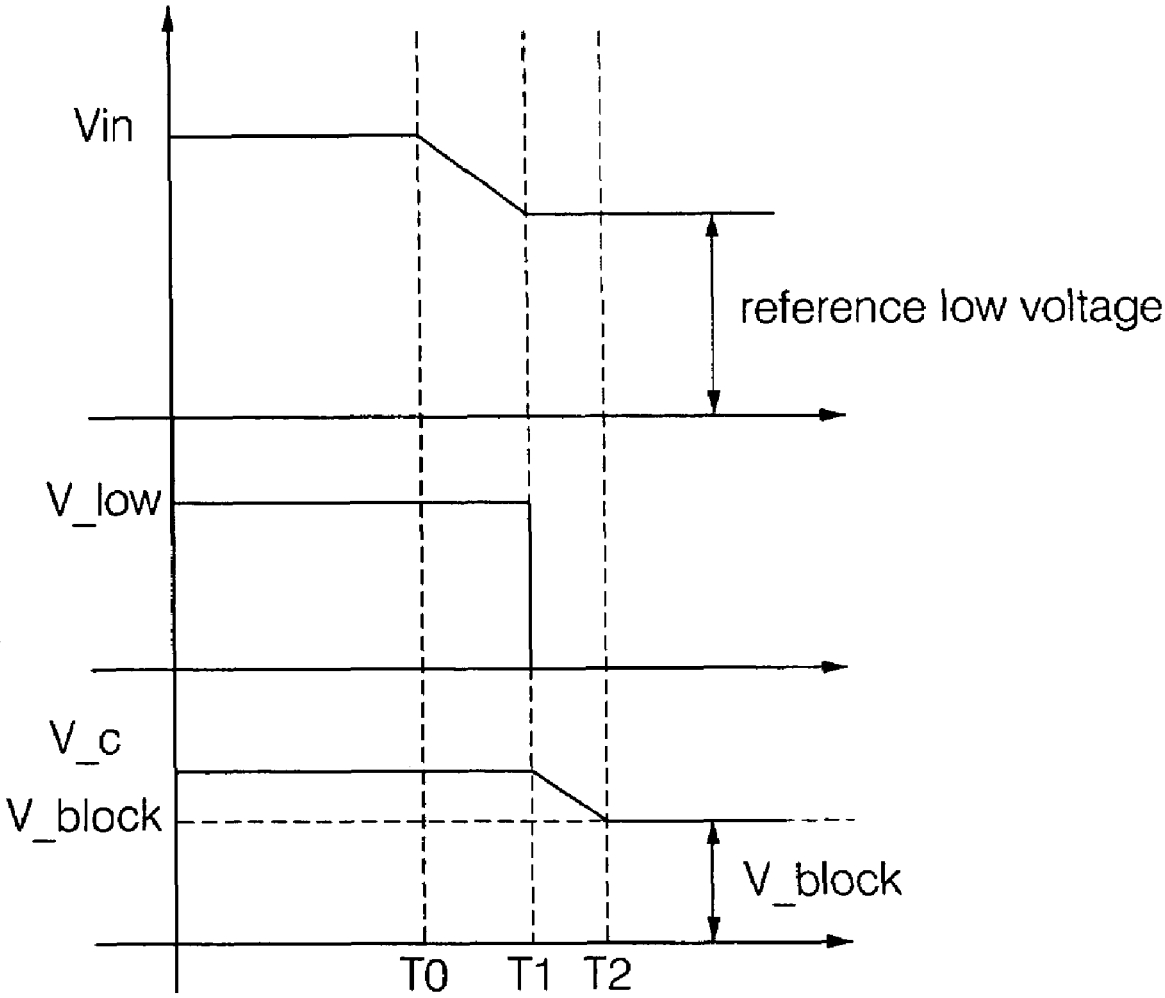
FIG. 6 is a graph illustrating output waveforms of individual components contained in a circuit of the induction-heating cooking apparatus according to the present invention.

If the output control signal (V_c) is higher than the blocking voltage (V_block) at step S4, the input voltage compensator 110 compensates for the blocking voltage (V_block) generated from the power-level limiter according to the input voltage (Vin), so that the output power level is limited at step S5, as shown in FIG. 6*a*.

Referring to FIG. 6*a*, the low-voltage detection signal (V_low) is changed to a low-level signal at a T1 point at which the input voltage (Vin) is lowered and the low-voltage signal is received, and the blocking voltage (V_block) less than the output control signal (V_c) generated from the microprocessor occurs at a T2 point, such that the input voltage can be compensated for.

Figure 6B:
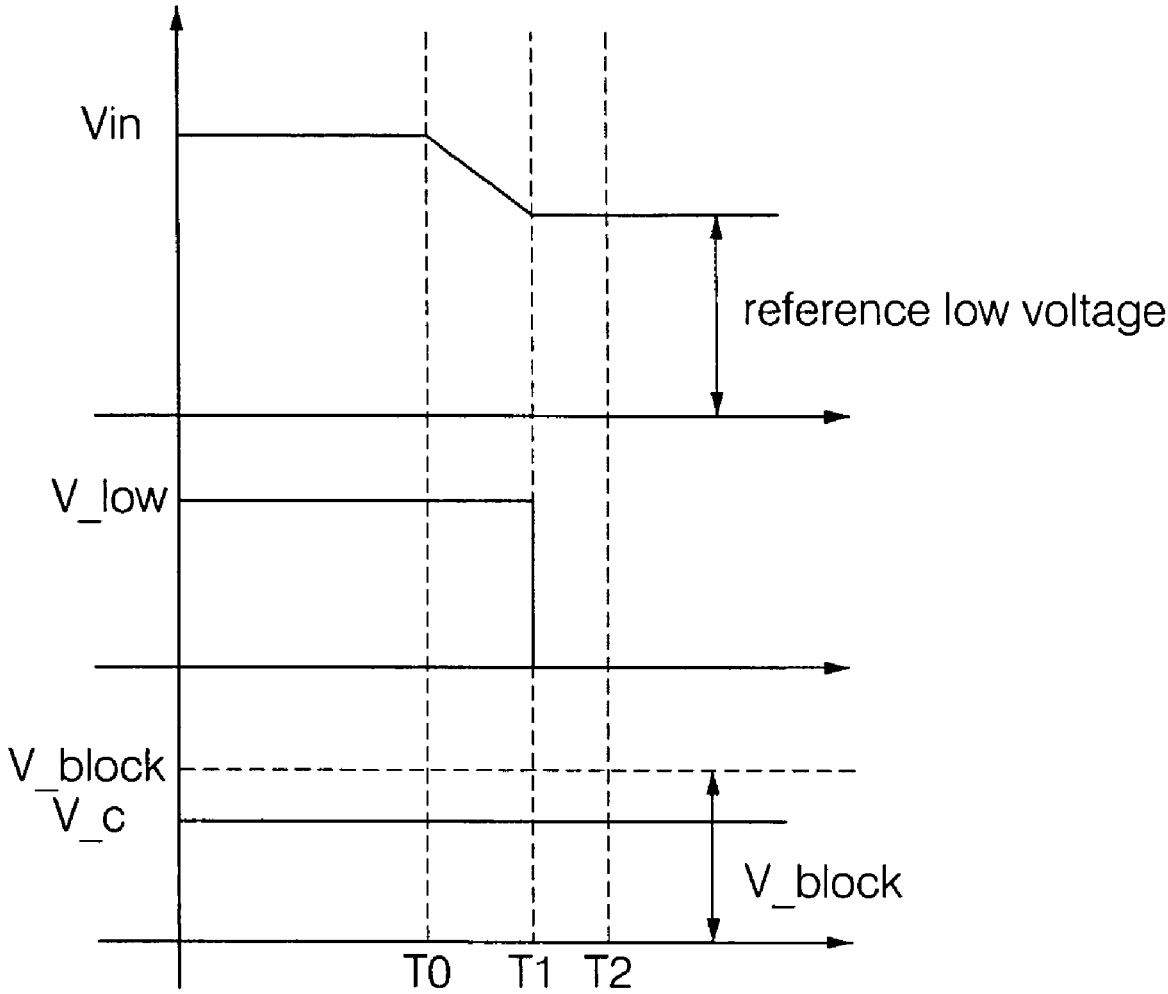

On the contrary, if the output control signal (V_c) is less than the blocking voltage (V_block), the input voltage compensator 60 compensates for the input voltage (Vin) according to the output control signal (V_c) generated from the microprocessor at step S6, as shown in FIG. 6*b*.

In more detail, although the low-voltage detection signal (V_low) is changed to a low-level signal at the T1 point at which the input voltage (Vin) is lowered and the low-voltage signal is received, the output control signal (V_c) is less than the blocking voltage (V_block), such that the input voltage is compensated according to the output control signal (V_c) instead of the blocking voltage (V_block).

In this manner, upon receiving the low-voltage signal, a compensation component of the input voltage (Vin) is determined by the smaller one between the output control signal (V-c) or the blocking voltage (V_block) signal, so that the compensation component is more limited than that of the conventional art. An operation frequency is controlled by the compensation component of the input voltage (Vin) so that the degree of the operation frequency reduction is limited, so that a driving pulse suitable for the operation frequency is generated at step S7.

Since the driving pulse, frequency of which is variably controlled, is applied to the inverter at step S8, a frequency and an output signal are controlled in only the ZVC area although a high-output signal and a low-voltage signal are received, such that the inverter can prevent the switch from receiving a high instantaneous current.

As apparent from the above description, the above-mentioned induction-heating cooking apparatus and the method for operating the same according to the present invention allows the output level of the inverter from being controlled in only the ZVS area, although a resonance frequency is changed according to a substance of the cooking container or a low-voltage signal is transmitted to the apparatus in a high-output state.

Therefore, the apparatus prevents the occurrence of excessive power loss during the switching operation, and also prevents the switch from receiving a high instantaneous current, resulting in increased endurance of cooking appliances.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An induction-heating cooking apparatus comprising:

an inverter unit for performing a switching operation upon receiving a driving pulse, and providing a coil, on which a cooking container is seated, with a current signal;

an input voltage detector for detecting an input voltage applied to the inverter;

a low-voltage detector for generating a low-voltage decision signal by comparing the input voltage detected by the input voltage detector with a predetermined reference voltage, the low-voltage decision signal being at a first level when the input voltage is lower than the reference voltage, the low-voltage decision signal being at a second level when the input voltage is higher than the reference voltage;

a power-level limiter for generating a blocking voltage capable of limiting an output power level to a predetermined power level only when the low-voltage decision signal is at the first level;

a microprocessor for generating an output control voltage to allow the inverter unit to generate an output signal suitable for individual output levels;

an input voltage compensator for determining a smaller one of the output control voltage and the blocking voltage, and compensating the smaller one of the output control voltage and the blocking voltage according to a variation of the input voltage; and an output controller for generating a frequency control signal capable of controlling a switching operation frequency of the inverter unit to compensate for an output power level according to a compensation component of the input voltage compensator.

2. The apparatus according to claim 1, further comprising:

a pulse generator for generating a driving pulse, a frequency of which is changed according to the frequency control signal; and a switch driver for transmitting the driving pulse generated from the pulse generator to a gate of a switch contained in the inverter unit.

3. The apparatus according to claim 2, further comprising:

an AC power-supply unit for providing the circuit with an AC power-supply signal;

a rectifier for rectifying the AC power-supply signal received from the AC power-supply unit, and generating a ripple power-supply signal; and a filter unit for filtering the ripple power-supply signal rectified by the rectifier, and transmitting the filtered power-supply signal to the inverter circuit.

4. The apparatus according to claim 3, wherein the input voltage detector is connected to the AC power-supply unit.

5. The apparatus according to claim 2, wherein the pulse generator variably controls a pulse width in inverse proportion to the frequency control signal, and generating/outputting the driving pulse.

6. The apparatus according to claim 1, wherein the low-voltage detector includes a comparator in which a positive(+) terminal receives the input voltage and a negative(−) terminal receives the predetermined reference voltage, such that the comparator generates the low-voltage decision signal at the first level when the input voltage is less than the predetermined reference voltage.

7. The apparatus according to claim 1, wherein the power-level limiter includes:

an inverse diode for connecting a cathode to an output terminal of the low-voltage detector, and being switched on only when the low-voltage decision signal is at the first level; and a zener diode for connecting an anode to the inverse diode such that the blocking voltage is applied to both ends of the zener diode due to a current signal generated when the inverse diode is switched on.

8. The apparatus according to claim 1, wherein the output controller controls the operation frequency of the inverter unit in inverse proportion to the compensation component generated from the input voltage compensator.

9. The apparatus according to claim 1, wherein the first level is a low level and the second level is a high level.

10. A method for operating an induction-heating cooking apparatus comprising the steps of:

detecting an input voltage applied to an inverter;

comparing the input voltage with a predetermined reference voltage;

when the input voltage is lower than the predetermined reference voltage, generating a blocking voltage and comparing an output control voltage generated from a microprocessor with the blocking voltage;

compensating for the input voltage by a differential component associated with the blocking voltage when the blocking voltage is lower than the output control voltage, and compensating for the input voltage by a differential component associated with the output control voltage when the output control voltage is lower than the blocking voltage in such a way that an output control operation is performed; and controlling a switching operation frequency according to a compensation component of the input voltage, and driving an inverter.

11. The method according to claim 10, further comprising the step of:

if the input voltage is not lower than the predetermined reference voltage, compensating for the input voltage by a different component associated with the output control voltage generated from the microprocessor in such a way that an output control operation is performed.

12. The method according to claim 10 wherein the step of controlling the switching operation frequency includes the steps of:

controlling a switching operation frequency control signal in inverse proportion to the compensation component of the input voltage;

generating a driving pulse, a pulse width of which is controlled in inverse proportion to the frequency control signal; and beginning an inverter operation according to the driving pulse.

13. The method according to claim 10, further comprising:

when the input voltage is lower than the reference voltage, generating a low-voltage decision signal at a first level; and when the input voltage is higher than the reference voltage, generating the low-voltage decision signal at a second level.

14. The method according to claim 13, wherein the step of generating the blocking voltage includes generating the blocking voltage only when the low-voltage decision signal is at the first level.

15. The method according to claim 14, wherein the first level is a low level and the second level is a high level.

* * * * *